United States Patent [19]

Vansadia

[11] Patent Number: 5,024,578

[45] Date of Patent: Jun. 18, 1991

[54] REGENERATIVE PUMP WITH TWO-STAGE STRIPPER

[75] Inventor: Ghanshyamsinh D. Vansadia, Sterling Heights, Mich.

[73] Assignee: General Motors Corporation, Detroit, Mich.

[21] Appl. No.: 419,297

[22] Filed: Oct. 10, 1989

[51] Int. Cl.[5] ..... F04D 5/00; F04D 9/02

[52] U.S. Cl. ..... 415/55.1; 415/52.1; 415/55.3; 415/55.4; 415/169.1; 417/366

[58] Field of Search ..... 415/52.1, 55.1, 55.3, 415/55.4, 169.1; 417/435, 366

[56] References Cited

U.S. PATENT DOCUMENTS

| | | | |
|---|---|---|---|
| 4,502,827 | 3/1985 | Shows | 414/217 |
| 4,538,958 | 9/1985 | Takei et al. | 415/53 |
| 4,591,311 | 5/1986 | Matsuda et al. | 415/53 |
| 4,653,979 | 3/1987 | Schillinger | 415/53 |
| 4,734,008 | 3/1988 | Roth | 415/53 |

*Primary Examiner*—Robert E. Garrett
*Assistant Examiner*—Frank H. Stephan
*Attorney, Agent, or Firm*—Saul Schwartz

[57] ABSTRACT

A regenerative rotary pump in an automotive fuel pump assembly. The rotary pump has a disc-shaped impeller in a circular cavity of a housing, vanes around the circumference of the impeller separated by pockets, a donut-shaped pumping chamber in the housing enveloping the vanes and the pockets on the impeller, a two-stage stripper between a discharge at a high pressure end of the pumping chamber and an inlet at a low pressure end of the pumping chamber, and a vent chamber between a high pressure stage and a low pressure stage of the two-stage stripper. The vent chamber is connected to the fuel tank removed from the inlet. High pressure gasoline carried by the pockets between the vanes flashes to vapor in the vent chamber to minimize the vapor jet stream effect at the inlet end of the pumping chamber.

4 Claims, 2 Drawing Sheets

REGENERATIVE PUMP WITH TWO-STAGE STRIPPER

FIELD OF THE INVENTION

This invention relates generally to rotary pumps and, more particularly, to regenerative pumps in automotive fuel pump applications.

BACKGROUND OF THE INVENTION

In so-called regenerative rotary pumps, a disc-shaped impeller with vanes around its circumference rotates at relatively high speed in a housing having a donut-shaped pumping chamber enveloping the circumference of the impeller. The pumping chamber is interrupted by a reduced cross-section portion, commonly referred to as a stripper, which separates a pumping chamber inlet from a pumping chamber discharge. During each revolution of the impeller, the vanes motivate fluid from the inlet to the discharge while interacting with the surrounding pumping chamber to boost the pressure of the fluid at the discharge. The stripper isolates the discharge from the inlet except for individual volumes or slugs of high pressure fuel trapped between the vanes as they traverse the stripper and any blow-by or leakage across the stripper through the running clearance between the impeller and the housing. Under high ambient temperature conditions or high gasoline fuel temperature in automobile fuel pump applications, high pressure gasoline trapped between the vanes and/or leaking across the stripper may flash to vapor near the pumping chamber inlet and create a jet stream cavitation effect disturbing the flow characteristics at the inlet. A regenerative pump according to this invention includes a stripper which relieves the pressure of the trapped gasoline to minimize the jet stream cavitation effect.

SUMMARY OF THE INVENTION

This invention is a new and improved regenerative type rotary pump particularly suited for automobile fuel pump applications. The regenerative pump according to this invention includes a disc-shaped impeller having a plurality of vanes around its circumference, a housing having a donut-shaped pumping chamber surrounding the vanes on the impeller, and a two-stage pressure vented stripper between a pumping chamber inlet and a pumping chamber discharge. The pressure vented stripper has a high pressure stage adjacent the pumping chamber discharge, a low pressure stage adjacent the pumping chamber inlet, and a vent between the high and low pressure stages connected to the fuel tank at a location removed from the pumping chamber inlet. The high pressure fuel trapped between the vanes and/or leaking across the stripper from the high pressure end of the pumping chamber encounters the vent between the high and low pressure stages of the stripper where pressure is relieved so that only low pressure fuel remains trapped between the vanes and little or no gasoline leaks across the low pressure stage of the stripper to the pumping chamber inlet. The vent is connected to the fuel tank at a location removed from the pumping chamber inlet so that vapor generated at the vent is not drawn in at the inlet.

DESCRIPTION OF THE PREFERRED EMBODIMENT

Figure 1:
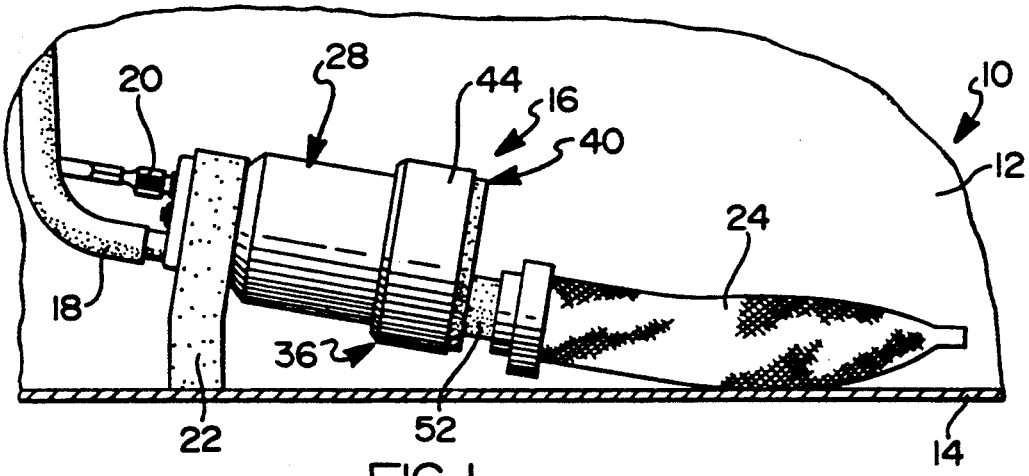
FIG. 1 is a fragmentary elevational view, partially in section, of an automobile fuel tank having a submerged fuel pump assembly including a regenerative pump according to this invention.
Figure 2:
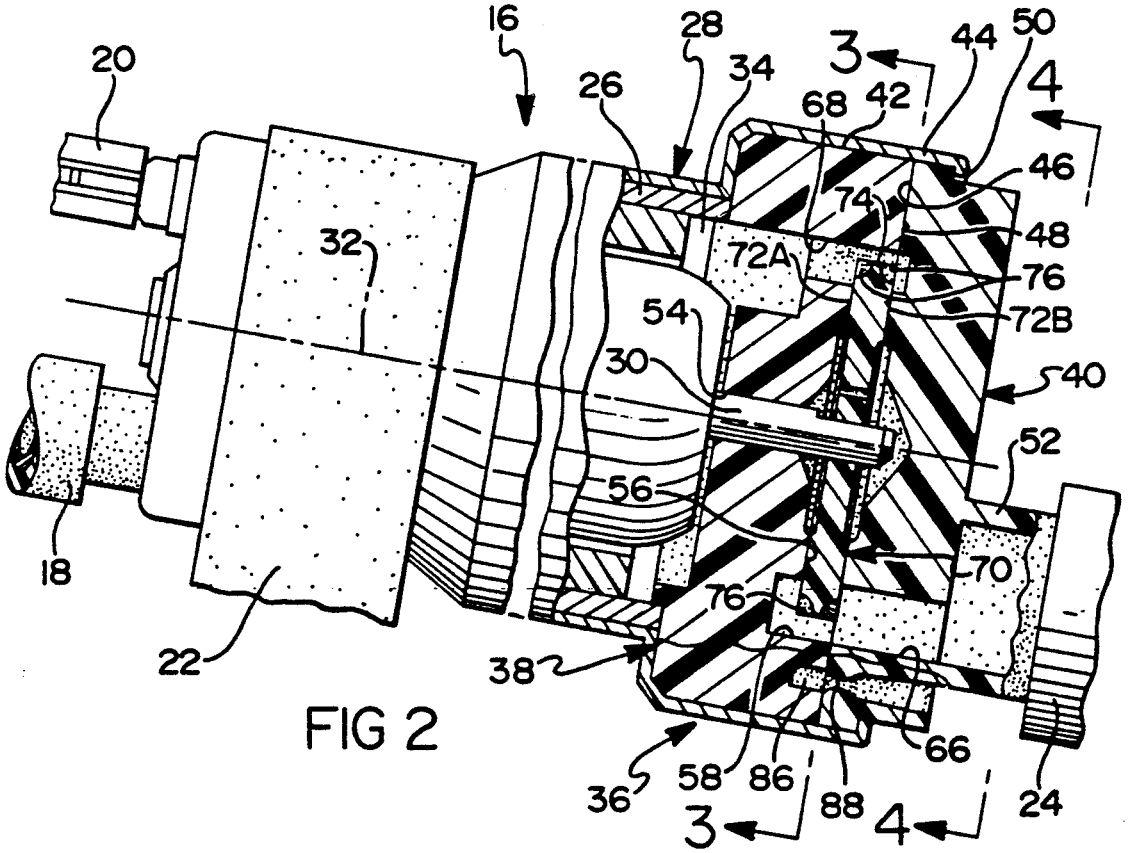
FIG. 2 is an enlarge partially broken-away view of a portion of FIG. 1.

Referring to FIGS. 1 and 2, an automobile fuel tank 10 has an interior fuel chamber 12 one side of which is defined by a bottom wall 14 of the tank. A fuel pump assembly 16 is suspended within the fuel chamber 12 adjacent the bottom wall 14 on the lower end of a fuel discharge tube 18 through which the pump assembly 16 supplies fuel to the engine of the vehicle. The pump assembly 16 is normally submerged in gasoline. A schematically illustrated wiring harness 20 conducts current to an electric motor of the pump assembly 16 whereby operation of the pump assembly is synchronized with the state of the ignition of the vehicle. An elastomeric bumper 22 connected to the pump assembly 16 bears against the bottom wall 14 to control vibration. A tubular inlet screen 24 of the fuel pump assembly is attached to the pump assembly 16. The electric motor of the fuel pump assembly forms no part of this invention and may be of the type described in U.S. Pat. Nos. 3,418,991 and 4,209,284, each assigned to the assignee of this invention. Briefly, the motor includes a cylindrical flux ring 26 within a generally tubular shell 28 of the pump assembly. The motor has an armature shaft 30 which is rotatable about a longitudinal axis 32 of the shell 28 when the motor is turned on. The armature shaft is disposed in an internal volume 34 of the shell 28 which communicates with the fuel discharge tube 18. A regenerative pump 36 according to this invention closes the right end, FIG. 2, of the shell 28 and is driven by the armature shaft 30.

Referring to FIGS. 2-5, the regenerative pump 36 includes a first housing 38 and a second housing 40. The first housing 38 has a cylindrical outside wall 42 closely received in and keyed or otherwise non-rotatably connected to an enlarge portion 44 of the shell 28. The second housing 40 is generally disc-shaped and has a circular end wall 46 perpendicular to the axis 32. The end wall 46 abuts a similar end wall 48 of the first housing 38. The shell 28 is crimped over an annular shoulder 50 on the second housing 40, FIG. 2, whereby the first and second housings 38 and 40 are pressed tightly together at the interface between end walls 46 and 48. A cylindrical flange 52 on the second housing 40 defines a mounting detail for the tubular screen 24.

The armature shaft 30 is rotatable in a bore 54 in the first housing 38 aligned on the axis 32. The armature shaft projects through the bore 54 into a circular cavity in the end wall 48 of the first housing. As seen best in FIGS. 2 and 5, the circular cavity has a bottom wall 56 and a cylindrical side wall 58. The bottom wall 56 has an annular groove 60 therein immediately adjacent the side wall 58. The open side of the circular cavity is closed by the end wall 46 of the second housing 40 which cooperates with the bottom wall 56 in defining the ends of the circular cavity. An annular groove 62 is defined in the end wall 46 of the second housing 40 opposite the annular groove 60 in the bottom wall 56 of the circular cavity. The grooves 60 and 62 cooperate with the side wall 58 and the portion of the circular cavity between the grooves in defining a generally donut-shaped pumping chamber 64 in a plane perpendicular to and centered around the axis 32.

Figure 3:
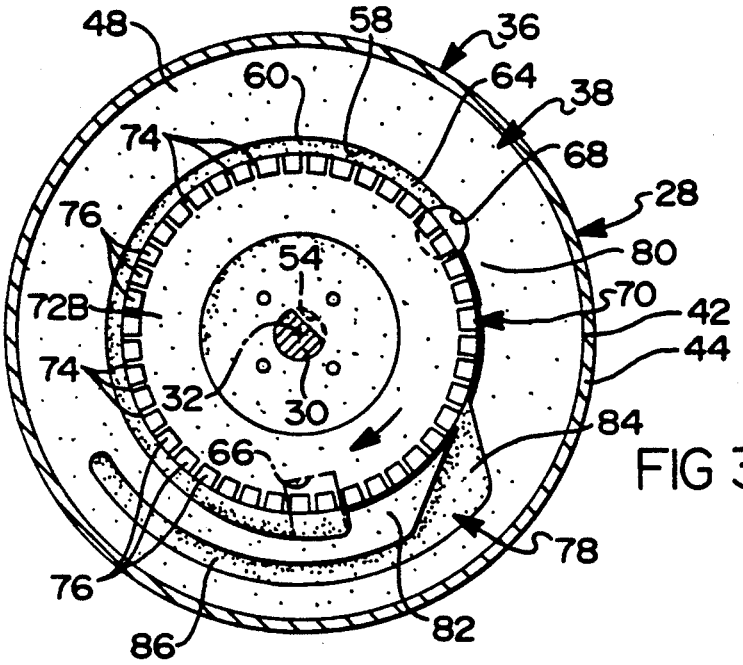
FIG. 3 is a view taken generally along the plane indicated by lines 3—3 in FIG. 2.
Figure 4:
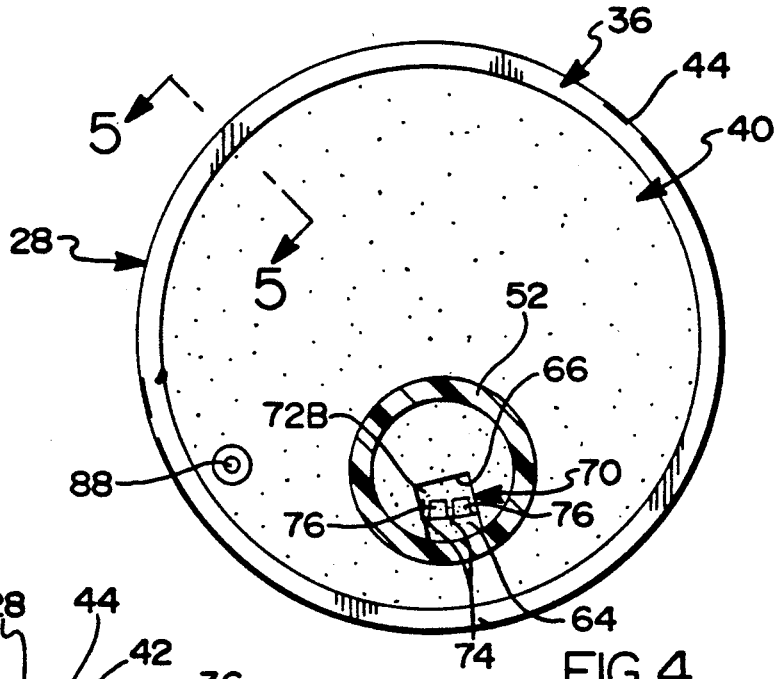
FIG. 4 is a view taken generally along the plane indicated by lines 4—4 in FIG. 2.
Figure 5:
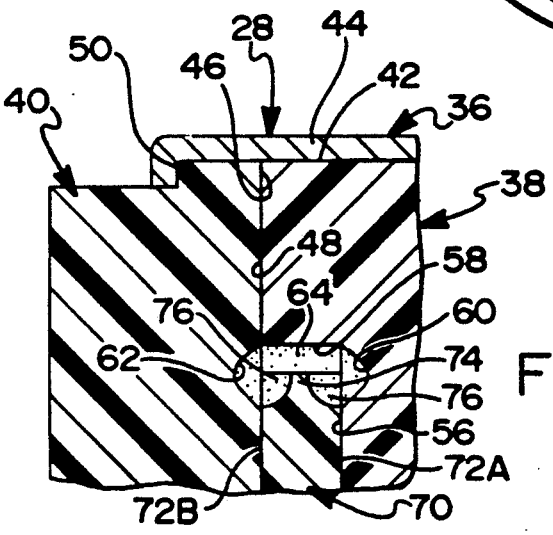
FIG. 5 is a sectional view taken generally along the plane indicated by lines 5—5 in FIG. 4.

As seen best in FIGS. 2–4, the pumping chamber 64 communicates with the fuel chamber 12 of the tank 10 through an inlet 66 located inside the flange 52. All fuel flowing into the inlet 66 is filtered by the screen 24. The pumping chamber 64 communicates with the internal volume 34 in the shell 28 through a discharge 68.

A disc-shaped impeller 70 is disposed within the circular cavity and connected to the armature shaft 30 for rotation as a unit therewith. The impeller 70 has a pair of flat, circular sides 72A-B which face, respectively, the bottom wall 56 of the circular cavity and the end wall 46 of the second housing 40. The impeller 70 fills substantially the entire circular cavity except for the pumping chamber 64 which envelops the circumference of the impeller. A plurality of so-called closed-type vanes 74 are formed around the circumference of the impeller and are located within the pumping chamber 64. The vanes are separated by a plurality of pockets 76 in the impeller which open radially and through the sides 72A-B of the impeller into the pumping chamber 64.

As seen best in FIG. 3, the cross-section of the pumping chamber 64 is reduced in the clockwise angular interval between the discharge 68 and the inlet 66 by a vented stripper 78 which closely receives the circumference of the impeller 70. The vented stripper 78 includes a high pressure stage 80 immediately adjacent the discharge 68 and a low pressure stage 82 immediately adjacent the inlet 66. The high and low pressure stages 80 and 82 are separated by a vent or diffuser chamber 84 the sides of which diverge in a general V-shape from the circular cavity. The vent chamber 84 communicates with the fuel chamber 12 of the tank 10 through an arc-shaped duct 86 and a vapor bleed restriction 88 at the end of the duct. Restrictions having diameters in the range of 0.035–0.070 inches have been found optimum. The bleed restriction 88 is removed from the inlet 66 outside the flange 52, FIG. 4.

The regenerative pump 36 operates as follows. When the motor of the pump assembly 16 is turned on, the armature shaft 30 rotates the impeller 70 clockwise, FIG. 3. Impeller speeds may be in the range of about 1500–10000 RPM. The vanes 74 on the impeller traverse the pumping chamber 64 in the direction proceeding from the inlet 66 to the discharge 68. With the pump submerged, gasoline fills the inlet 66 and is motivated by the vanes 74 along the pumping chamber toward the discharge 68. With a flow restriction downstream of the discharge 68, the vanes 74 cooperate with the pumping chamber in known regenerative pump fashion to increase the pressure of the gasoline from about ambient at the inlet to a higher pressure at the discharge which may be in the range of 3–105 PSI.

Due to the close running clearance between the high pressure stage 80 of the stripper 78 and the impeller 70, substantially only the high pressure gasoline in the pockets 76 between the vanes is carried by the impeller 70 from the discharge end of the pumping chamber 64 toward the inlet end of the pumping chamber. When the succeeding pockets of high pressure gasoline, and any leakage between the impeller and the high pressure stage 80 of the stripper, encounter the vent chamber 84, the pressure of the gasoline drops rapidly to about ambient due to the connection to the fuel chamber 12 through the duct 86 and bleed 88. If the temperature of the gasoline is high, as on a hot summer day, the gasoline may flash to vapor in the vent chamber 84. The vapor is transported to the fuel chamber 12 through the duct 86 and vapor bleed 88. Because the vapor bleed is removed from the inlet 66, the flow characteristics of the gasoline at the inlet are not disturbed.

The residual low pressure gasoline in the pockets 76 between the vanes 74 is transferred by the impeller from the vent chamber 84 across the low pressure stage 82 of the stripper to the inlet end of the pumping chamber 64. Because the residual fuel is at substantially ambient pressure, there is no tendency to vaporize at the inlet end nor is there any tendency for gasoline or vapor to leak from the vent chamber 84 to the inlet end of the pumping chamber. Consequently, there is possibly only very weak flow-disturbing vapor jet stream cavitation effect near the inlet 66.

The embodiments of the invention in which an exclusive property or privilege is claimed are defined as follows:

1. In an automotive fuel pump assembly, a regenerative rotary pump comprising:

a housing defining a circular cavity having a cylindrical side wall and a pair of circular end walls, means on said housing defining a pair of annular grooves in respective ones of said circular end walls adjacent said cylindrical side wall and cooperating with said cylindrical side wall in defining an annular pumping chamber, a disc-shaped impeller supported in said circular cavity for rotation in a pumping direction, means on said impeller defining a plurality of circumferentially spaced vanes around said impeller in said pumping chamber separated by a plurality of pockets open to said pumping chamber, means on said housing defining a fluid inlet connected to said pumping chamber and to a source of fluid at substantially ambient pressure, means on said housing defining a fluid discharge from said pumping chamber angularly spaced from said inlet in said pumping direction of rotation of said impeller and connected to a flow restriction downstream of said fluid discharge so that said vanes cooperate with said pumping chamber in motivating said fluid from said inlet toward said discharge and in increasing the pressure of said fluid at said discharge, means on said housing defining a high pressure stripper stage adjacent said discharge closely receiving said impeller so that direct communication between said discharge and said inlet in said pumping direction of rotation of said rotor is foreclosed, means on said housing defining a low pressure stripper stage between said high pressure stripper stage and said inlet closely receiving said impeller, means on said housing defining a vent chamber between said high pressure stripper stage and said low pressure stripper stage exposed to said pockets on said impeller, and means defining a vapor bleed between said vent chamber and said source of fluid at ambient pressure at a location removed from said inlet.

2. The regenerative rotary pump recited in claim 1 wherein said vanes on said rotor are closed-type vanes.

3. The regenerative rotary pump recited in claim 2 wherein said source of fluid at substantially ambient pressure is an automobile fuel tank and said housing is normally in liquid fuel in said fuel tank.

4. The regenerative rotary pump recited in claim 3 wherein a screen is disposed between said fuel tank and said inlet and said vapor bleed is exposed to said fuel tank outside said screen.

* * * * *